US006079963A

United States Patent [19]

Endo et al.

[11] Patent Number: 6,079,963

[45] Date of Patent: Jun. 27, 2000

[54] DISPLACEMENT TYPE COMPRESSOR AND METHOD OF FORMING COATING FILM

[75] Inventors: Yoshishige Endo; Eiichi Satoh, both of Tsuchiura; Akihiko Yamamoto; Yuji Yoshitomi, both of Ibaraki-ken; Koichi Inaba; Koichi Sekiguchi, both of Tochigi-ken, all of Japan

[73] Assignee: Hitachi, Ltd., Tokyo, Japan

[21] Appl. No.: 08/923,822

[22] Filed: Sep. 4, 1997

[30] Foreign Application Priority Data

Sep. 5, 1996 [JP] Japan ..... 8-255569

[51] Int. Cl.[7] ..... F04C 29/00

[52] U.S. Cl. ..... 418/55.2; 418/178

[58] Field of Search ..... 418/55.2, 178

[56] References Cited

U.S. PATENT DOCUMENTS 4,579,512 4/1986 Shiibayashi et al. ..... 418/178

4,724,172 2/1988 Mosser et al. ..... 428/697

FOREIGN PATENT DOCUMENTS 132993 11/1978 Germany ..... 418/178

55-81294 6/1980 Japan .

58-57002 4/1983 Japan .

61-79883 4/1986 Japan ..... 418/178

3-246389 11/1991 Japan .

*Primary Examiner*—John J. Vrablik

*Attorney, Agent, or Firm*—Antonelli, Terry, Stout & Kraus, LLP

[57] ABSTRACT

A scroll type compressor comprises a stationary scroll and a rotary scroll which is assembled with the stationary scroll so as to define a closed space, the outer surface of the rotary scroll 22 is formed thereon with a tin compound film containing a tin compound and having a thickness of 50 $\mu$m. Such a coating film is never peeled off from a member even after long time operation, and is excellent in sealability and conformability, in the displacement type compressor.

5 Claims, 5 Drawing Sheets

PHOTOGRAPH ILLUSTRATING
SECTION OF STANNATE COATING FILM

DISPLACEMENT TYPE COMPRESSOR AND METHOD OF FORMING COATING FILM

BACKGROUND OF THE INVENTION

The present invention relates to a displacement type compressor, and in particular to surface treatment preferable for enhancing the efficiency of a scroll compressor used in an air-conditioning unit, a refrigerator and an air compressor unit.

RELATED ART

Conventionally, various surface treatment methods have been proposed for a displacement type compressor in which a closed space defined between a stator and a rotor is gradually decreased in association with motion of the rotor so as to suck, compress and discharge fluid, and in particular, for a scroll type compressor in which a pair of scrolls (wraps) angularly shifted from each other and meshed with each other are subjected to circular motion, relative to each other so as to move a closed space defined between both wraps toward the center part while the volume thereof is compressed to discharge the compressed fluid from the center part. The purpose of the surface treatment is to decrease leakage of fluid to be compressed between the wraps or between the wraps and associated planar plates (mirror plates), as far as possible, and to make the slidability between the members making contact with each other, satisfactory, thereby it is possible to prevent the efficiency from being lowered due to frictional losses.

For example, Japanese Laid-Open Patent No. 55-81294 discloses a method for plating either one of scroll members with copper or lead bronze. Further, Japanese Laid-Open Patent No. 58-57002 discloses a method as a method which satisfies both wear-resistance and conformability between slidable parts, of carrying out high-frequency quenching and manganese phosphate coating treatment (lubrite treatment). Meanwhile, a method as a method which prevents the wraps of the scroll members and the mirror plate from making direct contact with each other, comprising the steps of forming grooves in the tip end parts of the wraps along the spiral thereof, and filling engineering plastic having satisfactory slidability and wear-resistance in these grooves (tip seal process) has been proposed. For example, Japanese Laid-Open 3-246389 discloses a method which can reduce gaps between the tip seals and the grooves.

In such a case that a slidable part of a scroll type compressor is formed on its surface with a coating film such as a plating coating film, made of a material different from the material of the member, the temperature and the pressure increase during compression stroke, various conditions such that a temperature difference and a pressure differential are caused between the outer peripheral part and the center part, change, and accordingly, repetitive stress is applied to the coating film which therefore cracks in long time use so that the coating film peels off. In the most worst case, fragments of the peeled-off coating film would cause eccentric abrasion.

In such a case that the surface of the slidable part is subjected to a phosphate manganese process, satisfactory characteristics such as slidability and wear-resistance can be obtained. However, the phosphate manganese coating film (lubrite coating film) has a relatively high hardness and high surface roughness. Accordingly, a relatively long time is required until the slidable parts become conformable against each other during assembly of the scroll type compressor, thereby the productivity thereof has been inferior. For example, if a rotary scroll is subjected to leubrite treatment so as to form a coating film having a thickness of about 10 $\mu$m, the time of longer than five hours has been required until the performance of the compressor becomes stable after the slidable parts are conformable therebetween. Further, a self-glowing type coating film of this kind has a limited thickness up to about 15 $\mu$m at maximum.

As mentioned above, when the scroll type compressor is operated, since a pressure differential and a temperature difference are caused between the outer peripheral part or a gas suction part and the center part or a gas discharge part, both rotary scroll and stationary scroll would be deformed. This deformation, in particular, the deformation of the rotary scroll in the lap-heightwise direction, causes the gap between the rotary scroll and the stationary scroll associated with the former to increase, and as a result, leakage increases so that the efficiency of the compressor is greatly lowered. In more detail, the temperature and the pressure are both low at the outer peripheral part, and both become higher and higher toward the center part. Thus, large stress is exerted to the lap of the rotary scroll from the center part to the outer peripheral part. Accordingly, it deforms as if flower leafs are opened. Thus, the gap between the tip end wrap of the rotary scroll and the mirror surface for the stationary scroll becomes wider toward the outer peripheral part from the center part, and as a result, leakage increases so that the efficiency of the compressor is lowered. The degree of this deformation (heightwise deformation) which differs, depending upon an operating condition of the compressor, becomes about 20 $\mu$m at maximum. Accordingly, since a conventional self-growing coating film such as a lubrite coating film has a thickness up to about 15 $\mu$m at maximum, the degree of this deformation cannot be absorbed by the coating film.

That is, even though the wrap formed thereon with a coating film having a certain thickness is assembled so that the coating film surface thereof makes contact with a slidably mated part, and the coating film is made into slidably contact with the slidably mated part so as to be worn, for preventing the base metal of the wrap from making contact with the slidably mated part, when a force deforming the wrap in a direction in which the wrap is pressed against the slidably mated part in an operating condition is produced, the base metal of the wrap is inevitably made into contact with the slidably mated part if the thickness of the coating film is smaller than the degree of deformation of the wrap. As a result, the coating film at the tip end of the wrap in the center part is worn out completely, and accordingly, the base metal of the wrap slides on the mirror surface of the stationary scroll as the slidably mated part. If the base metal is of iron group, that is, it is a casting of, for example, FC250, the wrap can hardly be worn. Thus, unless this part is worn by operating the compressor for a long time, the gap cannot become narrow, and accordingly, the efficiency cannot be increased.

Meanwhile, a method in which a groove is formed in the tip end part of the wrap along the spiral, and engineering plastic which is excellent in slidability and wear-resistance is filled in the groove (tip seal method), can provide a stable slidability, but spiralwise leakage (leaking through gaps between the rear surface and side surface of the tip seal and the groove) is inevitably caused. Thus, it is difficult to enhance the efficiency of the compressor.

SUMMARY OF THE INVENTION

An object of the present invention is to provide a coating film, in a displacement type compressor, which can be prevented from being peeled off from a component even after long time operation, and which is excellent in sealability and conformability, thereby it is possible to actually provide a highly efficient compressor.

The above-mentioned object can be fulfilled by a coating film which is formed on either one or both of the surfaces of a stator and a rotor where the stator and the rotor make contact with each other, which contains a tin compound and which has a predetermined thickness (which will be hereinbelow denoted as tin compound coating film).

In order to form the tin compound film, a member to be formed therewith is at first alkaline-degreased, and is then washed with pure water. At this time, the alkali-degreasing solution is preferably heated up to a temperature of, for example, about 50 to 80 deg. C. Then, the outer surface of the member is subjected to oxidation-etching by using inorganic acid. As the inorganic acid, any one of aqueous solutions of hydrochloric acid, sulfuric acid, nitric acid or hydrofluoric acid or a mixed aqueous solution thereof is used. At this time, this aqueous solution is preferably be used at a room temperature, but may be heated up to a temperature of about 50 deg. C. For example, in the case of using nitric acid, an aqueous solution of 5 wt. % nitric acid is preferably used. After etching, the member is washed with pure water, and then an alkaline aqueous solution is prepared for pH adjustment for the surface of the member. An aqueous solution in which 0.5 to 1 wt. % of sodium hydroxide is dissolved, is preferably used as the alkaline aqueous solution. After pH adjustment, the member is again washed. Alternatively, after the etching is carried out without carrying out the pH-regulation and the washing after the pH adjustment, the member may be washed with pure water, and then the next step may be directly taken.

Then, a coating film forming process is carried out with the mixed aqueous solution containing stannate as a main component. In addition to the stannate, a pH-regulator, a reaction accelerator, a stabilizer and the like may preferably be added into the solution. Potassium stannate, sodium hydroxide and sodium pyrophosphate or sodium acetate are preferably used as the stannate, the pH-regulator and the stabilizer, respectively. Further, sodium hypophosphite or the like may be added in order to promote the reducing reaction. At this time, the temperature of the solution is set preferably to be in a range from 80 to 95 deg. C. Should the temperature be lower than 80 deg. C., the reaction rate would be insufficient so that a satisfactory stannate compound coating film cannot be formed. Further, should it be higher than 95 deg. C., the reaction within the mixed solution would be promoted before the reaction with the member, thereby it is difficult to stably form the compound with the member. Further, the time of formation of the coating film can be arbitrarily set in accordance with a required thickness thereof. After the processing, it is washed, and it is preferably is dried and baked at a temperature, which is preferably in a range from 150 to 200 deg. C.

Since this stannate compound coating film is formed not by coating the member with a material different from that of the member as a plated coating film, but by forming a compound with the member, it is possible to prevent peel-off of the coating film from the member or the like. In this arrangement, although sufficient sealability and conformability can be obtained only by coating either one of the stator and the rotor with the stannate coating film, but the similar characteristic can be obtained by coating both of them. This stannate compound coating film is particularly preferable for the member made of a material selected from an iron group including cast iron and carbon steel. In this case, the compound is Fe—Sn compound which exhibits excellent conformability.

The thus formed stannate compound coating film has a surface roughness on a relatively soft surface made of the Fe—Sn compound and is porous, and accordingly, no cracks caused by stress occur in the coating film, different from a plated coating film, and as well, the conformability can be obtained in a relatively short time (excessive thickness may be decreased by abrasion), that is, the frictional coefficient thereof is low so that the friction loss is also low. Further, since it is porous, it is effectively retentive of oil in such a case that the stannate compound coating film slides, making contact with the associated member under the present of oil.

It is noted that sodium stannate, in addition to potassium stannate, can exhibit a similar result when it is used as the stannate.

Explanation will be hereinbelow made of preferred embodiments of the present invention with reference to the drawings in which:

DESCRIPTION OF PREFERRED EMBODIMENTS

Explanation will be made of embodiments of the present invention with reference to FIGS. 1 to 4.

Figure 1:
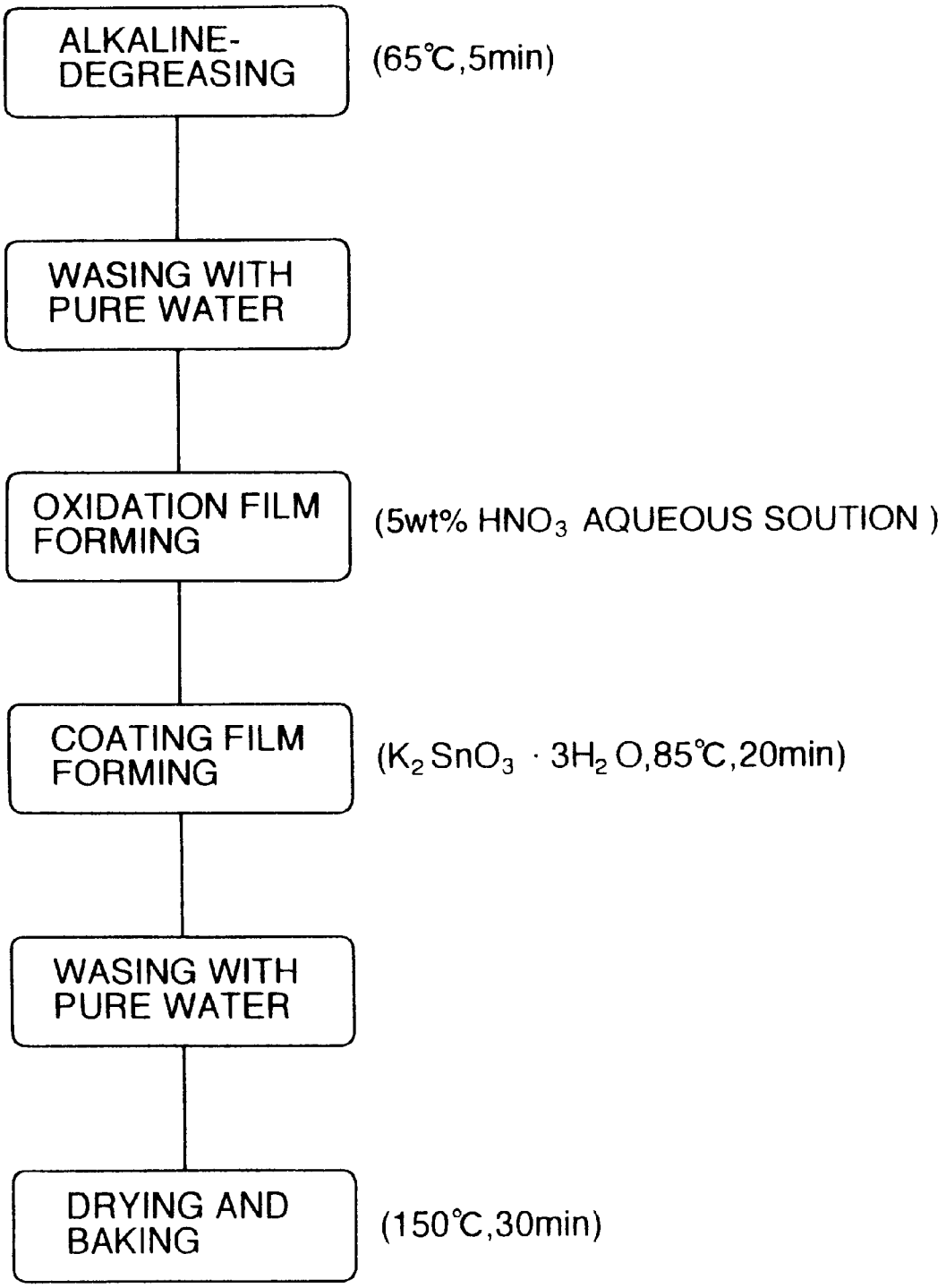
FIG. 1 is a view for explaining a procedure in an embodiment of the present invention.

FIG. 1 shows a coating process according to the present invention. An FC250 member to be formed with a tin compound coating film is at first washed through alkaline-degreasing (using degreasing liquid FC315 made of Nihon Parkerizing Co., for 5 minutes at a temperature of 65 deg. C.), and thereafter, it is washed with pure water. Then, the outer surface of the member is dipped in an aqueous solution containing 5 wt. % of nitric acid for 5 minutes after it is heated up to 30 deg. C., and after oxidation-etching, it is washed with a stream of ion-exchange water.

Thereafter, a stannate mixed solution composed of the following components, and the above-mentioned FC250 member to be processed is dipped in the mixed solution under such a condition such as a temperature of 85 deg. C. for 20 minutes, in order to form a stannate compound coating film.

| Stannate Mixed Solution | |
|---|---|
| $K_2SnO_3.3H_2O$: | 4.5 wt. % |
| NaOH: | 1.0 wt. % |
| $CH_3COONa.3H_2O$: | 1.0 wt. % |
| $Na_4P_2O_7$: | 0.5 wt. % |
| $H_2O$: | the balance |

Thereafter, washing with pure water is carried out, and then drying and baking are made in a furnace at a temperature of 150 deg. C. for 30 minutes.

The result of analysis for the surface of the tin compound coating film formed under the above-mentioned condition showed that the thickness of the coating film is about 50 $\mu$m, and the thin film X-ray diffraction analysis gave the results listed in Table 1.

TABLE 1

| Crystal Phase | $FeSnO(OH)_5$ | α-Fe | FeC | C(Graphite) |
|---|---|---|---|---|
| Processed Film | ++++ | +++ | + | ++++ |

++++: Very Large Quantity,
+++: Large Quantity,
+: Small Quantity $FeSnO(OH)_5$ detected therein is FeO(OH).Sn(OH)4. From Table 4, it is understood that a sufficient quantity of Fe–Sn compound was created. It is noted that Carbon or C detected similar to the Fe—Sn compound is contained in the member made of cast iron (by 3 to 4 wt. %). Since carbon exists by a large quantity at the surface as mentioned above, a satisfactory result is brought about for the slidability.

Figure 2:
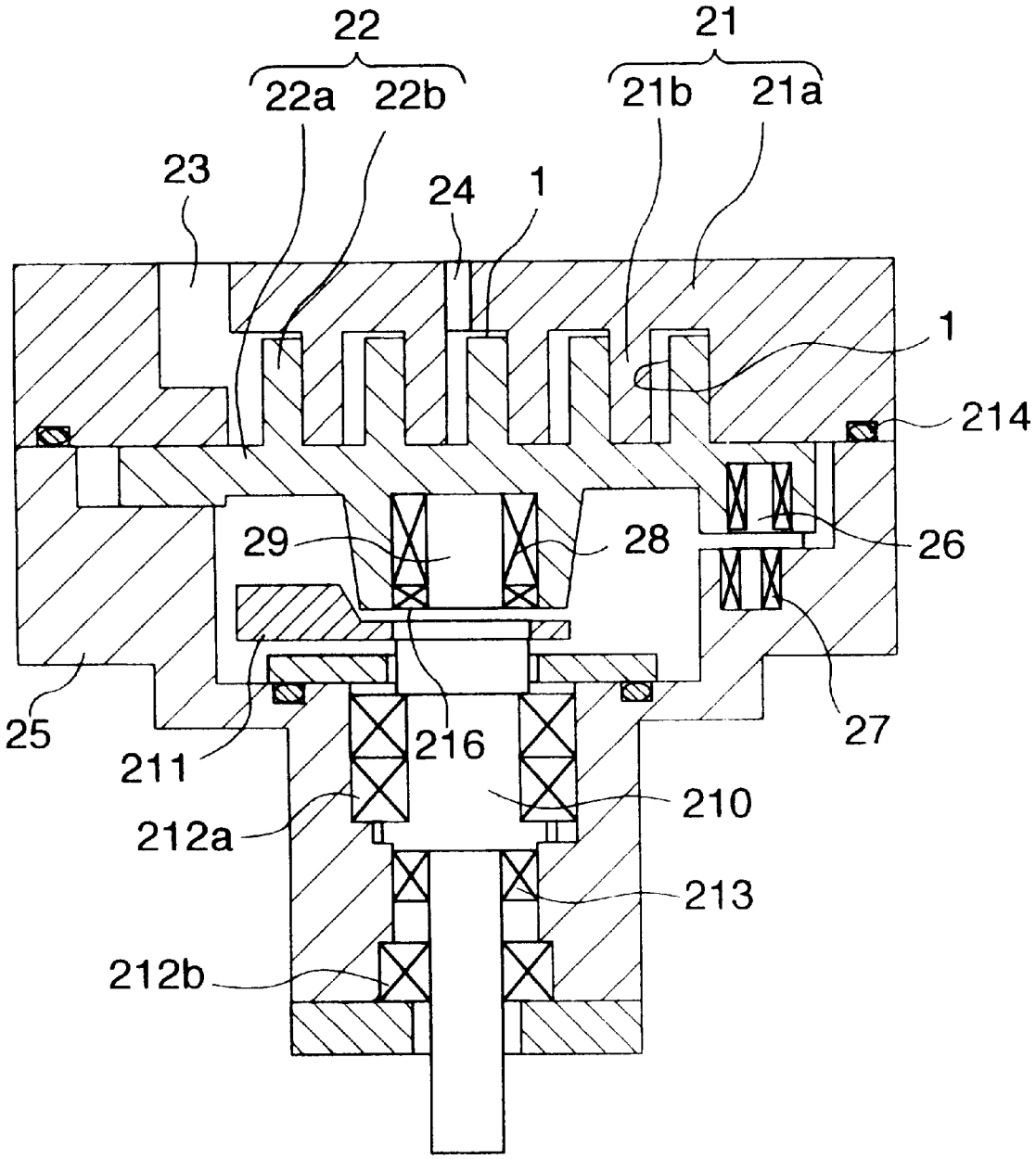
FIG. 2 is a longitudinal sectional view illustrating a scroll type compressor in an embodiment of the present invention.

Next, explanation will be made of an example in which the tin compound coating film is applied for a scroll type compressor. Referring to FIG. 2 which shows the structure of the scroll type compressor, a stationary scroll 21 as a stator is composed of a mirror plate 21*a* and a spiral scroll wrap 21*b*, the scroll wrap 21*b* being formed in its outer peripheral part with a suction port 23 for gas, and in its center part with a discharge port 24. The stationary scroll 21 is coupled to a casing 25 through the intermediary of an annular seal member 214 so that the scroll wrap 21*b* is directed toward the casing 25. Meanwhile a rotary scroll 22 as a rotor is composed of a mirror plate 22*a* having a bearing 28 at its enter thereof, and a spiral scroll wrap 22*b* standing upright to the mirror plate 22*a*. The rotary scroll 22 is located with respect to the stationary scroll 21 so that the scroll wrap 21*b* is meshed with the scroll wrap 22*b*, and the peripheral edge part of the mirror plate 22*a* is slidably clamped between the stationary scroll 21 and the casing 25 in a sandwich-like configuration. The rotary scroll 25 is meshed with the stationary scroll 21 so that the angle between a line connecting between the center of the rotary scroll 22 and the outer peripheral side terminal end of the wrap and a line connecting between the center of the stationary scroll 21 and the outer peripheral side terminal end of the wrap is held to be constant, and accordingly, the rotary scroll 25 is inhibited from revolving at the outer peripheral part of the mirror plate 22*a* by means of a plurality of pin ranks 26 which are fixed at their one end to the casing 25 through the intermediary of bearings 27.

Further, a drive shaft 210 is provided for turning the rotary scroll 22, relative to the stationary scroll, without allowing the same revolving, the drive shaft 210 being supported by an upper bearing 212*a* and a lower bearing 212*b* which are secured to the casing 25. The drive shaft 210 has at its tip end a crank shaft 29 which is coupled to the rotary scroll 22 through the bearing 28. Further, the drive shaft 210 is fitted thereon with a bearing seal member 213 between the upper bearing 212*a* and the lower bearing member 212*b* so as to block fluid flowing along the drive shaft. The crank shaft 29 of the drive shaft 210 is provided thereto with a balance weight 211 for balancing a centrifugal force induced in association with the turning motion of the rotary scroll 22. Further, the outer peripheral part of the mirror plate 22*a* is slidably held between the stationary scroll 21 and the casing 25 in order to ensure stable motion for the rotary scroll 22. Grease of a perfluoropolyether group is used as a lubricant in the bearings 27, 28, 212*a*. Further, a seal member 216 for preventing the grease from leaking is provided at the lower end position of the bearing 29 for the crankshaft 29.

The scroll type compressor having the above-mentioned configuration is operated as follows, a closed space defined between the stationary scroll wrap 21*b* and the rotary scroll wrap 22*b* is shifted from the outer peripheral side to the center side of the wraps through the turning of the rotary scroll 22 so that its volume is decreased, and accordingly, gas compressed in this closed space is fed to the outside through the discharge port 24 formed in the stationary scroll 21 around the center of the latter.

Figure 3:
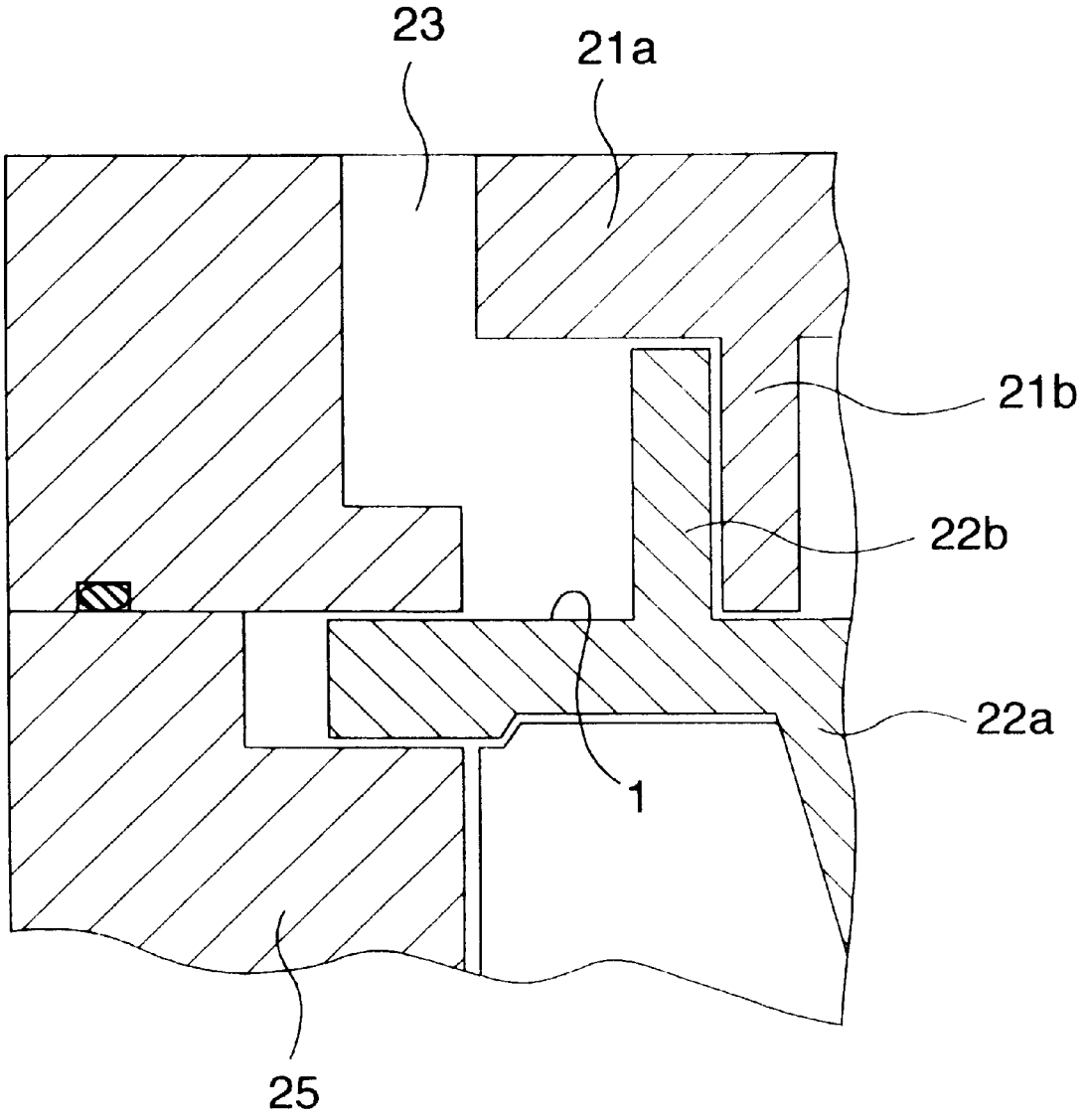
FIG. 3 is an enlarged sectional view illustrating a part of FIG. 3.

Next, explanation will be made of the main part according to the present invention. FIG. 3 which shows a part of FIG. 2 by an enlarged scale. In this example shown, the rotary scroll 22 is formed thereon with a tin compound coating film 1. In this embodiment, the surface of a rotary scroll which makes contact with a flow passage into which gas flows from the suction part 23 and from which gas flows out through the discharge port 24 is coated with the tin compound coating film in its entirety, and accordingly, no gas leaks from the flow passage in the member, intermediary thereof. In this arrangement, when the rotary scroll and the stationary scroll are regularly combined, a conforming margin of about 10 $\mu$m is ensured each of contact parts. In other words, the dimensions of contact parts are set so that rotary scroll and the stationary scroll overlap with each other by about 10 $\mu$m. Although the tin compound coating film basically reacts with Fe in the member, it does not self-grow dimensionally, and therefore, the above-mentioned setting can be made in a relatively simple manner.

It is noted that the compressor having newly assembled is operated preferably at a low speed so as to conform slide parts with each other upon starting of operation thereof. Further, with the use of a device which is exclusively used for running-in, and which can change the eccentricity of the rotary scroll with respect to the stationary scroll, the rotary scroll is assembled with the stationary scroll with zero eccentricity therebetween, and then, the eccentricity is gradually changed up to a regular value while the rotary scroll is rotated at a low speed so that they may both conform with each other.

An Fe—Sn compound coating film (tin compound coating film) is relatively soft and is excellent slidability, different from a conventional lubrite coating film, and accordingly, the above-mentioned overlap part can be polished in a relatively short time by the surface of the stationary scroll so as to conform with the latter. In such a manner, a gap at the tip end of the wrap upon deformation of the wrap can be decreased so as to allow leakage of gas to be substantially zero. Thus, the efficiency of the compressor can be remarkably enhanced, and as well, the time required for conforming operation for the slide parts during assembly can be shortened, thereby it is possible to enhance the manufacturing efficiency. The thickness of the tin compound coating film 1 which is formed by dipping the rotary scroll 22 or the stationary scroll 21 in the stannate mixed solution, should be set in consideration with the degree of deformation of the scroll wrap. However, it is desirable in view of a room for the conforming margin to set the thickness thereof to about 20 $\mu$m.

Figure 4:
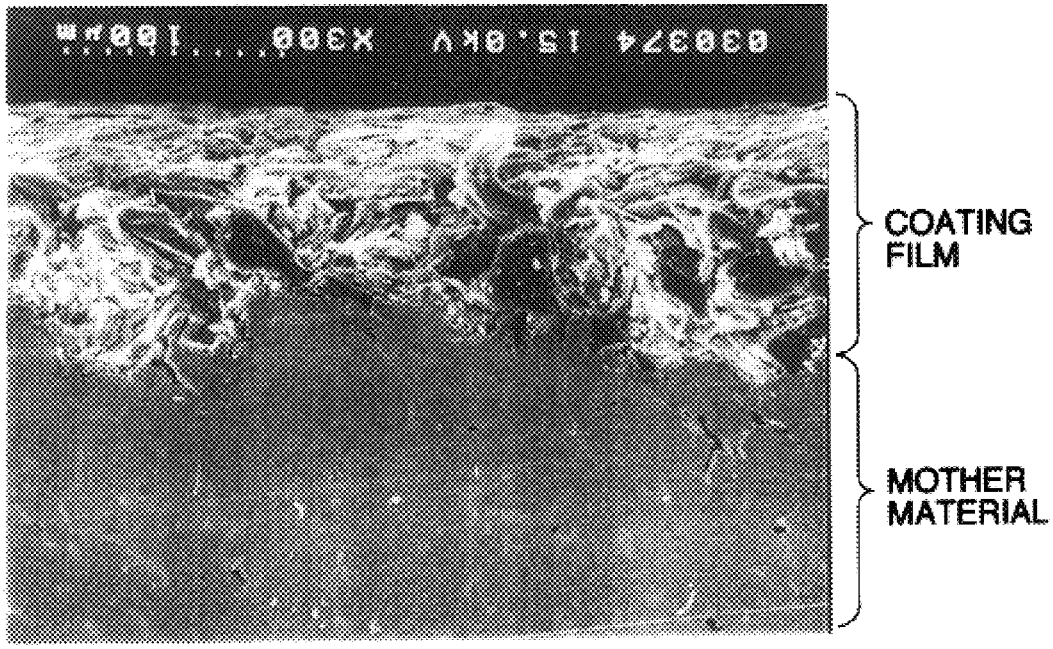
FIG. 4 is a sectional photograph illustrating the structure of a tin compound coating film according to the present invention.

FIG. 4 is a sectional photograph of the scroll formed with the tin compound coating film having a thickness of about 60

μm. Thus, according to the present invention, the thickness of the coating film can be increased, and accordingly, even though the degree of deformation of the tip end of the wrap is about 20 μm in the operating condition, the coating film can have a thickness which can afford to sufficiently absorb such a deformation.

Figure 5:
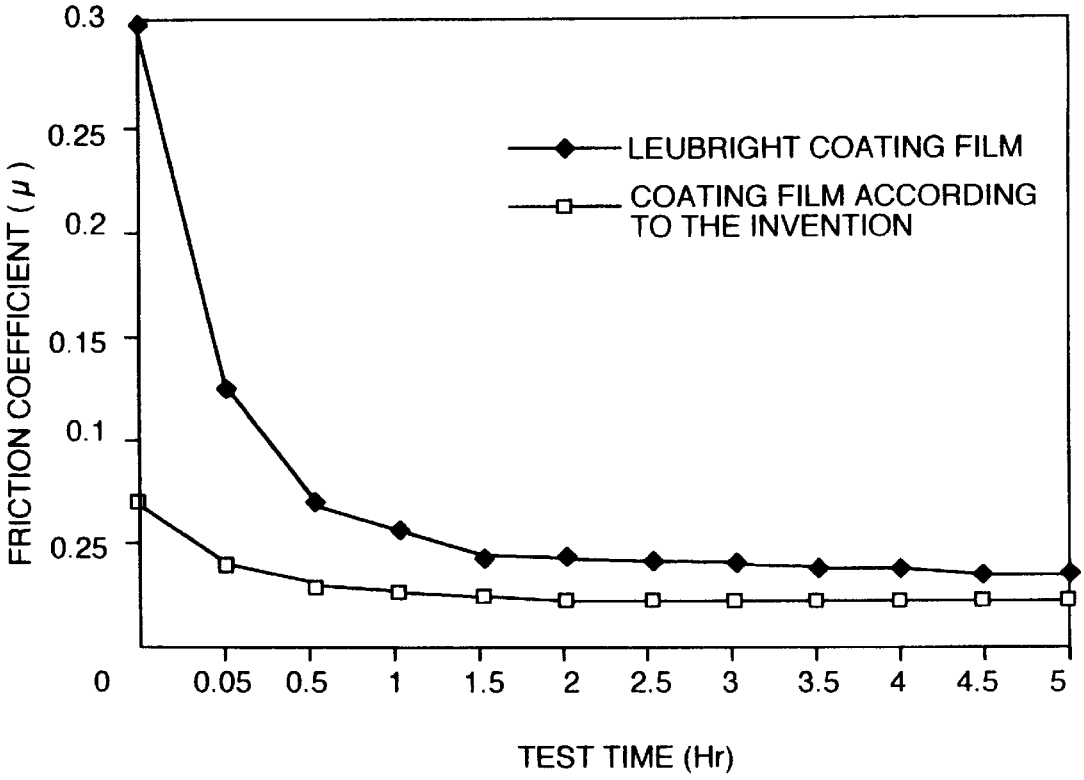
FIG. 5 is a graph for explaining the characteristic of a scroll type compressor incorporating the present invention.

Further, FIG. 5 shows the characteristic of the scroll type compressor manufactured as mentioned above. In this figure, the time elapsing from a start of operation of the compressor is taken on the abscissa, and the frictional coefficient as the index indicating the degree of conformability is taken on the ordinate. The characteristic of a conventional leubrite coating film is also shown in this figure for the purpose of comparison. It is clear from this figure that the compressor incorporating the tin compound coating film according to the present invention can stabilize its frictional coefficient by about two hours, and further, the frictional coefficient thereof is low in comparison with that incorporating the leubrite coating film. As to the performance of this compressor, the overall adiabatic efficiency is $\eta ad=88\%$.

The above-mentioned embodiment shows an example in which the slide surface of the scroll type compressor is formed thereon with a coating film containing a tin compound. However, even though slide parts of a screw compressor, a rotary compressor, a reciprocating compressor or the like is formed thereon with a coating film containing a tin compound, the similar effects can be obtained.

Further, when such an enhanced performance compressor is used in an air-conditioner, the air-condition can have an excellent performance.

As mentioned above, according to the present invention, the coating film containing a tin compound can be formed on a component surface where the stator and the rotor make contact with each other, in a relatively simple manner, and further, the coating film is never peeled off even after long time operation, that is, the coating film which is excellent in sealability and conformability, thereby it is possible to actually provide a compressor with a high degree of accuracy. Further, since the members are dimensionally overlapped with each other, and since they are slid with each other so as to be conformed with each other by polishing, it is possible to eliminate the necessity of severe dimensional accuracy during fabrication of the members, as has been required conventionally. Further, no unevenness occurs in performance in mass-production.

What is claimed is:

1. A displacement type fluid compressor wherein a closed space defined between a stator and a rotor is gradually decreased in association with motion of the rotor so as to suck, compress and discharge fluid, characterized in that at least one of surfaces of parts where the stator and the rotor make contract with each other comprises an iron group material and is formed thereon with a tin compound coating film comprising an Fe—Sn compound.

2. A displacement type fluid compressor as set forth in claim 1, characterized in that the tin compound coating film has a thickness of not less than 20 μm.

3. A displacement type fluid compressor as set forth in claim 1, characterized in that each of the outer surfaces of the stator and the rotor is coated with the tin compound coating film.

4. A displacement type fluid compressor as set forth in claim 1, characterized in that the tin compound coating film is formed in a mixed solution composed of stannate as a main component.

5. A displacement type fluid compressor as set forth in claim 4, characterized in that the stannate is potassium stannate.

* * * * *